US005585645A

United States Patent [19]

Goto

[11] Patent Number: 5,585,645

[45] Date of Patent: Dec. 17, 1996

[54] MEDIA DETECTOR EMPLOYING LIGHT GUIDES AND REFLECTORS TO DIRECT A LIGHT BEAM ACROSS THE TRANSPORT PATH WHICH IS INTERRUPTED BY THE PRESENCE OF THE MEDIA

[75] Inventor: Masao Goto, Tokyo, Japan

[73] Assignee: Oki Electric Industry Co., Ltd., Tokyo, Japan

[21] Appl. No.: 273,900

[22] Filed: Jul. 12, 1994

[30] Foreign Application Priority Data

Jul. 12, 1993 [JP] Japan ..... 5-171300

[51] Int. Cl.[6] ..... B41J 29/18; G01N 21/00; G01B 9/10

[52] U.S. Cl. ..... 250/559.12; 250/559.4; 250/227.24; 250/227.28; 356/387

[58] Field of Search ..... 250/559.4, 559.12, 250/227.11, 227.24, 223 R, 227.28; 356/375, 387

[56] References Cited

U.S. PATENT DOCUMENTS

| | | | |
|---|---|---|---|
| 3,655,989 | 4/1972 | Robinson | 250/227.11 |
| 4,166,214 | 8/1979 | Fuchs-Viniczay et al. | 250/227.11 |
| 4,716,942 | 1/1988 | Jensen et al. | 250/559.4 |
| 5,015,056 | 5/1991 | Yamaguchi et al. | 250/227.11 |
| 5,075,543 | 12/1991 | Courtney | 250/223 R |
| 5,260,564 | 11/1993 | Bruggeling et al. | 250/559.4 |
| 5,336,003 | 8/1994 | Nagashima et al. | 250/559.01 |

FOREIGN PATENT DOCUMENTS

| | | |
|---|---|---|
| 0143188 | 6/1985 | European Pat. Off. . |
| 0504997 | 9/1992 | European Pat. Off. . |
| 0532933 | 3/1993 | European Pat. Off. . |
| 3019486 | 11/1980 | Germany . |

*Primary Examiner*—Stephone Allen
*Attorney, Agent, or Firm*—Wenderoth, Lind & Ponack

[57] ABSTRACT

A media detector detects flat media traveling on a transport path formed by a pair of media guides. Light emitted from a light-emitting element enters the first media guide, is reflected within the first media guide, crosses the media transport path between the media guides, is reflected within the second media guide, and exits from the second media guide to a light-sensing element, which converts the light to an electrical signal. The light-emitting and light-sensing elements can be mounted, together with their associated electronics, on a single printed circuit board disposed adjacent to the two media guides, so that no interconnecting cables are necessary.

13 Claims, 11 Drawing Sheets

MEDIA DETECTOR EMPLOYING LIGHT GUIDES AND REFLECTORS TO DIRECT A LIGHT BEAM ACROSS THE TRANSPORT PATH WHICH IS INTERRUPTED BY THE PRESENCE OF THE MEDIA

BACKGROUND OF THE INVENTION

This invention relates to a media detector for use in an automatic teller machine, vending machine, scanner, copier, or other machine that must handle money, paper, plastic cards, or similar flat media.

Such a machine typically has a pair of flat media guides separated by a small gap forming a path through which media are transported by rollers. To monitor the passage of media on this transport path, the machine has a media detector comprising, for example, a light-emitting diode mounted above the upper media guide and a photodiode mounted below the lower media guide. The optic axes of these diodes are aligned with each other and with holes in the media guides so that normally a beam of light emitted by the light-emitting diode illuminates the photodiode. The presence of media in the path is detected when this beam is interrupted. If necessary, a row of two or more such pairs of diodes can be positioned across the transport path to detect the size, shape, or orientation of the media. The diodes are connected via cables to amplifier and detector circuitry on a separate printed circuit board.

A problem with this scheme is that additional structure is needed to support the diodes above and below the media guides. This structure, and the above-mentioned interconnecting cables, tend to get in the way during maintenance. The cables, moreover require connectors, which take up space and pose a reliability problem in that the cables may become accidentally loosened or detached. Furthermore, the complexity of the mounting and cabling adds to the cost of the detector. When more than one pair of diodes is employed, all these problems are multiplied.

SUMMARY OF THE INVENTION

It is accordingly an object of the present invention to simplify the structure of a media detector.

Another object is to increase the reliability of a media detector.

Yet another object is to simplify maintenance of a media detector and the machine in which it is used.

Still another object is to reduce the cost of a media detector.

The invented media detector comprises a light-emitting element, a light-sensing element, and a pair of media guides with internal light guides and reflectors. Light is emitted from the light-emitting element into the first media guide, is reflected within the first media guide, crosses the media transport path between the two media guides, is reflected within the second media guide, and exits from the second media guide to the light-sensing element. The light-emitting and light-sensing elements are preferably mounted, together with their associated electronic circuitry, on a printed circuit board disposed adjacent the two media guides.

DETAILED DESCRIPTION OF THE INVENTION

Embodiments of the invention will be described with reference to the attached drawings. These drawings illustrate the invention but do not restrict its scope, which should be determined solely from the appended claims.

Figure 1:
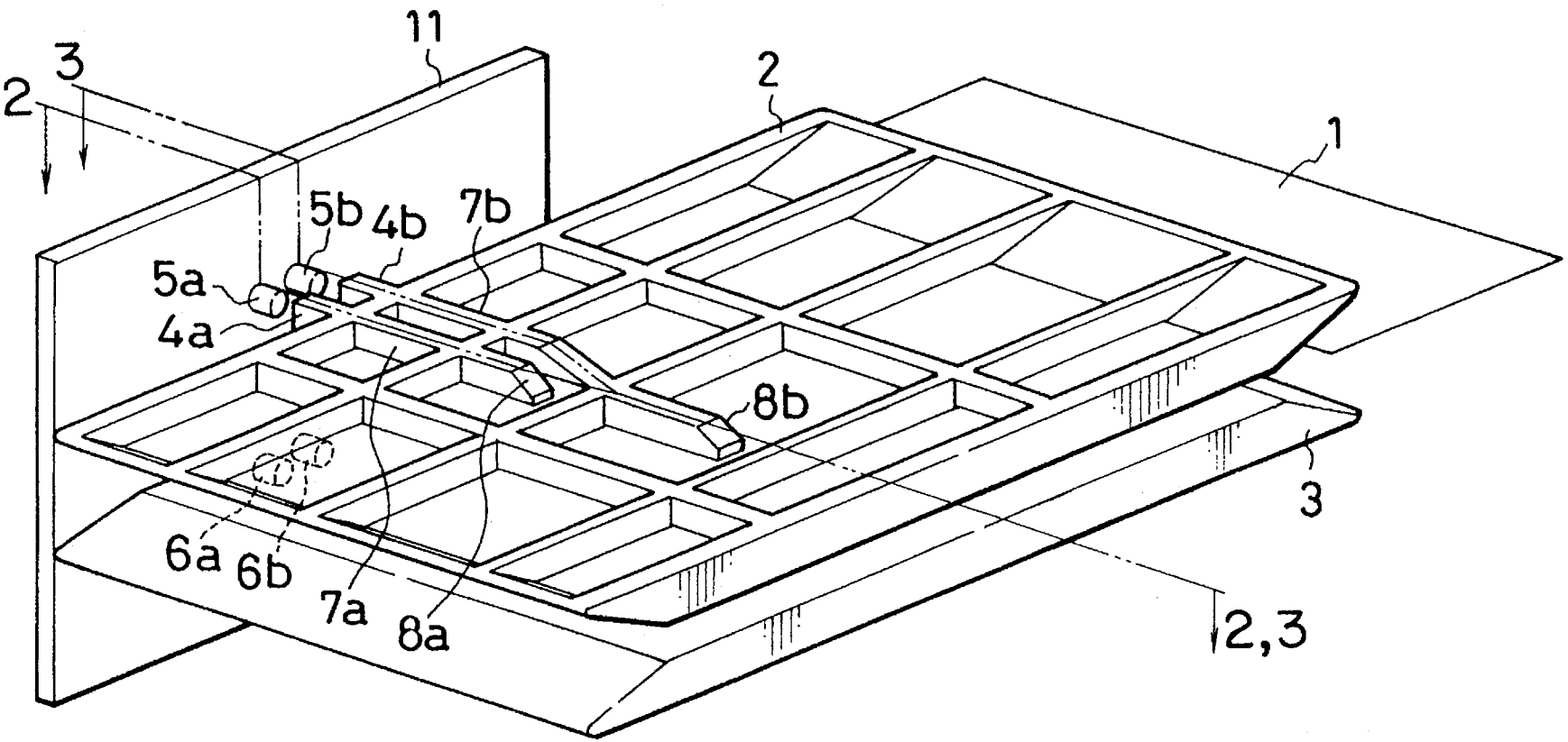
FIG. 1 is a perspective view of a first embodiment of the invented media detector.

In the first embodiment, shown in FIG. 1, flat media 1 such as paper currency are transported by rollers or other means (not shown) through a transport path between an upper media guide 2 and lower media guide 3. The upper and lower media guides 2 and 3 are made of a material such as plastic and have the general form of flat plates backed by ribs. They are separated by a suitable gap permitting easy transport of the media 1 between them.

Projecting from one side of the upper media guide 2 are a pair of entry ports 4*a* and 4*b* for receiving light from a pair of light-emitting elements 5*a* and 5*b* such as light-emitting diodes. The light-emitting elements 5*a* and 5*b* are mounted, e.g. by soldering, on a printed circuit board 11, facing entry ports 4*a* and 4*b*. A pair of light-sensing elements 6*a* and 6*b* such as photodiodes are also mounted on the printed circuit board 11, facing exit ports (described later) in the lower media guide 3. The printed circuit board 11 is equipped with amplifier circuits for light-emitting elements 5*a* and 5*b* and detector circuits for light-sensing elements 6*a* and 6*b*.

Entry ports 4*a* and 4*b* are the ends of a pair of light guides 7*a* and 7*b* which are integrated into ribs of the upper media guide 2. Entry ports 4*a* and 4*b* and light guides 7*a* and 7*b* are made of a transparent material, such as a clear plastic material. The other parts of the upper media guide 2 need not be transparent, but it is simplest if the entire media guide 2 is made of the same transparent material. Light guides 7*a* and 7*b* terminate in respective forty-five-degree reflectors 8*a* and 8*b* comprising, for example, reflective coatings on beveled ends of light paths 7*a* and 7*b*. Entry port 4*a*, light guide 7*a*, and reflector 8*a* are aligned on line 2—2', perpendicular to the direction of travel of the media 1. Light guide 7*b* is bent as indicated by line 3—3" so that reflector 8*b* is also disposed on line 2—2'.

Figure 2:
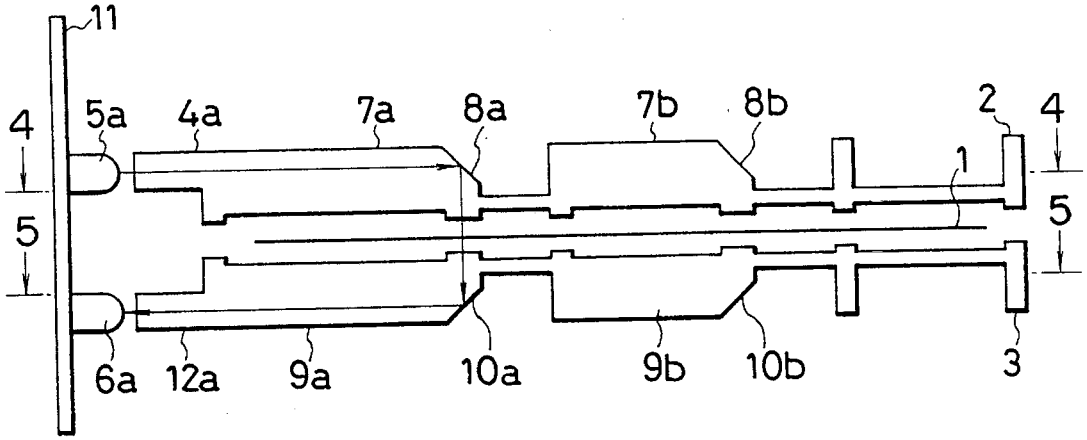
FIG. 2 is a sectional view along line 2—2' in FIG. 1.

Referring to FIG. 2, which is a sectional view through line 2—2' in FIG. 1, the lower media guide 3 has a pair of light guides 9*a* and 9*b*, similar to light guides 7*a* and 7*b*, which terminate in a pair of reflectors 10*a* and 10*b*, similar to reflectors 8*a* and 8*b*. Light-sensing element 6*a* faces an exit port 12*a* at one end of light guide 9*a*. Exit port 12*a* is similar to entry port 4*a*. Both have square, flat surfaces with height and width dimensions substantially equal to, or slightly larger than, the corresponding dimensions of light-emitting and light-sensing elements 5*a* and 6*a*. If light-emitting and light-sensing elements 5*a* and 6*a* are round, the height and width of entry and exit ports 4*a* and 12*a* should be substantially equal to the diameters of light-emitting and light-sensing elements 5a and 6a, or slightly larger. Light guides 7a and 9a have the same cross-sectional dimensions as entry and exit ports 4a and 12a.

Figure 3:
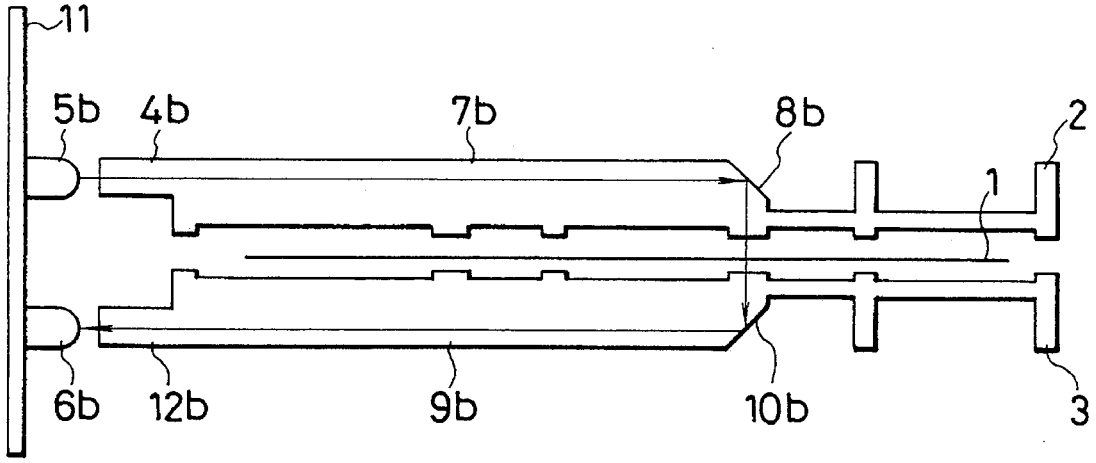
FIG. 3 is a sectional view along line 3—3" in FIG. 1.

Referring to FIG. 3, which is a sectional view through bent line 3—3" in FIG. 1, light guide 9b has an exit port 12b which faces light-sensing element 6b. Entry and exit ports 4b and 12b are similar to entry and exit ports 4a and 12a, with similar dimensional relationships.

Figure 4:
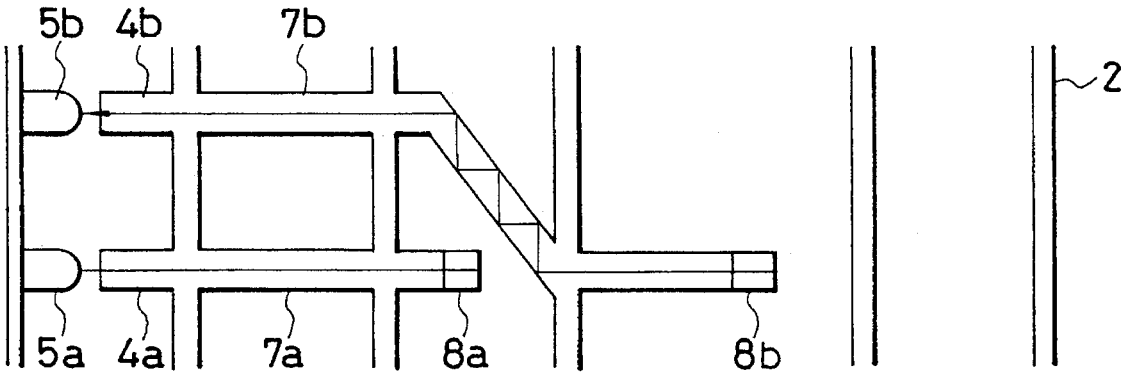
FIG. 4 is a sectional view along line 4—4' in FIG. 2.
Figure 5:
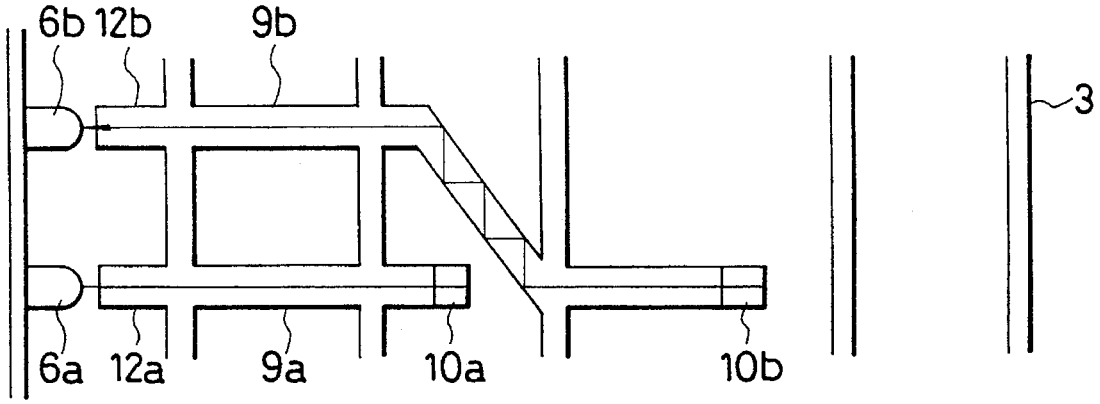
FIG. 5 is a sectional view along line 5—5' in FIG. 2.

FIG. 4 is a plan sectional view of part of the upper media guide 2, through line 4—4' in FIG. 2, showing the bent configuration of light guide 7b and the paths followed by light from light-emitting elements 5a and 5b to reflectors 8a and 8b. FIG. 5 is a plan sectional view of part of the lower media guide 3, through line 5—5' in FIG. 2, showing the bent configuration of light guide 9b and the paths followed by light from reflectors 10a and 10b to light-sensing elements 6a and 6b. Internal reflection from the sides of light guides 7b in FIG. 4 and 9b in FIG. 5 directs light around the bends in these light guides. If necessary, the sides of light guides 7b and 9b may be coated with a reflective material to ensure internal reflection.

Next the operation of the media detector will be described.

From FIGS. 2, 4, and 5, it can be seen that light emitted from light-emitting element 5a enters at entry port 4a, travels through light guide 7a, is reflected by reflector 8a, crosses the media transport path (provided no media 1 is present), is reflected again by reflector 10a, travels through light guide 9a, and exits at exit port 12a to light-sensing element 6a. Similarly, FIGS. 3, 4, and 5 show how light emitted from light-emitting element 5b enters at entry port 4b, travels through light guide 7b, is reflected by reflector 8b, crosses the media transport path (again provided no media 1 is present), is reflected a second time by reflector 10b, travels through light guide 9b, and exits at exit port 12b to light-sensing element 6b. Light-sensing elements 6a and 6b convert the incoming light to electrical signals for output to the detector circuits on the printed circuit board 11.

When media 1 are inserted in the position shown in FIG. 1 and move along the transport path between the upper and lower media guides 2 and 3, if the media orientation is correct, the leading edge of the media 1 will simultaneously break the two beams of light reflected from reflectors 8a and 8b, at which time the outputs of light-sensing elements 6a and 6b will simultaneously drop, and the detector circuitry on the printed circuit board 11 will recognize that media transport is proceeding normally.

If the media orientation is crooked, one beam will be broken before the other. The detector circuitry on the printed circuit board 11 can recognize the crookedness from the resulting time difference between the output transitions of light-sensing elements 6a and 6b. Suitable action can then be taken, such as stopping or reversing the direction of media transport.

Since light-emitting and light-sensing elements 5a, 5b, 6a, and 6b are mounted directly on the printed circuit board 11, these elements can be connected to their amplifier and detector circuits by printed wiring traces. No cables are required at all. Nor is any extra structure necessary for the support of elements 5a, 5b, 6a, and 6b. Compared with the prior art, in which light-emitting and light-receiving elements were mounted above and below guides 2 and 3, the invented media detector has a simpler and neater structure, which facilitates maintenance work. It is also more reliable, because there are no cables to become loosened, or connectors in which faulty electrical contacts might develop. The absence of cables, connectors, and supporting structures furthermore reduces the cost of the detector. The novel light guides 7a, 7b, 9a, and 9b and reflectors 8a, 8b, 10a, and 10b introduce little or no added cost or complexity because they are integrated into the upper and lower media guides 2 and 3.

The invention is not restricted to two light-emitting elements 5a and 5b and two light-sensing elements 6a and 6b. If it is not necessary to detect the orientation of the media 1, a single light-emitting element 5a and light-sensing element 6a will suffice. If it is necessary to detect the size, position, or shape of the media 1, additional light-emitting and light-receiving elements can be provided, with light guides and reflectors disposed in the media guides so that the beams cross the media transport path in any desired pattern. For example, three or more beams can be directed across the transport path at equally-spaced points disposed in a straight line perpendicular to the direction of media travel.

FIGS. 6 to 10 show a second embodiment of the invention, which has multiple light-receiving elements but only a single light-emitting element, resulting in further structural simplification. Parts of this embodiment that are similar to parts in FIGS. 1 to 5 are labeled with the same reference numerals. In particular, the lower media guide 3 and its light guides 9a and 9b, reflectors 10a and 10b, exit ports 12a and 12b, and light-sensing elements 6a and 6b are identical to those in FIGS. 1 to 5.

Figure 6:
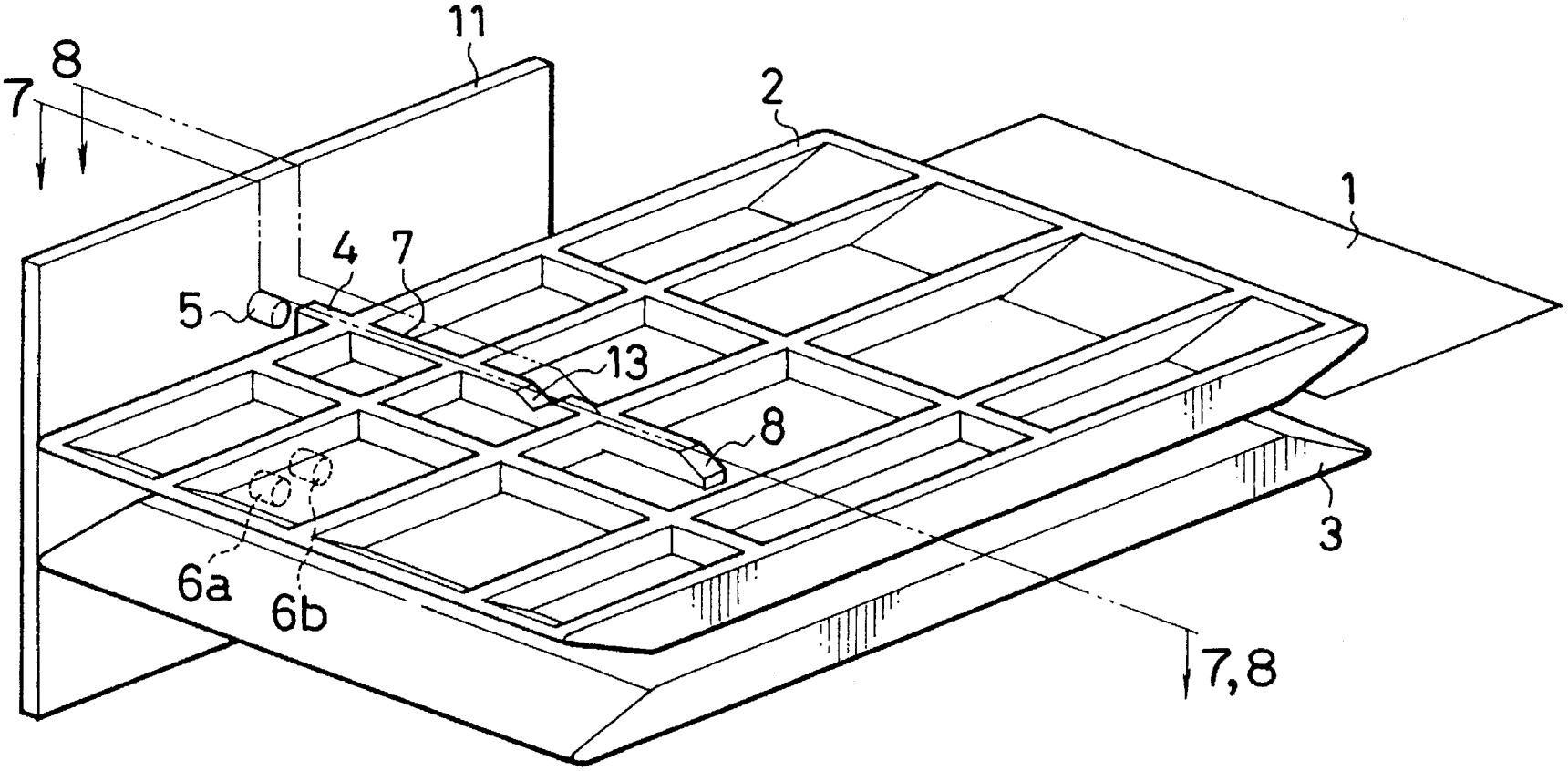
FIG. 6 is a perspective view of a second embodiment of the invented media detector.

Referring to FIG. 6, light from a single light-emitting element 5 enters a light guide 7 in the upper media guide 2 at an entry port 4 and is guided to a reflector 8. Light guide 7 also has an intermediate partial reflector 13, in the form of a V-shaped notch with a reflective coating in the upper surface of light guide 7. To reflect half the light input at entry port 4, the notch should extend halfway through light guide 7. For correct reflection, the leading edge of reflector 13 (the left edge of the notch in the drawing) should be inclined at an angle of forty-five degrees to the top of light guide 7.

Figure 7:
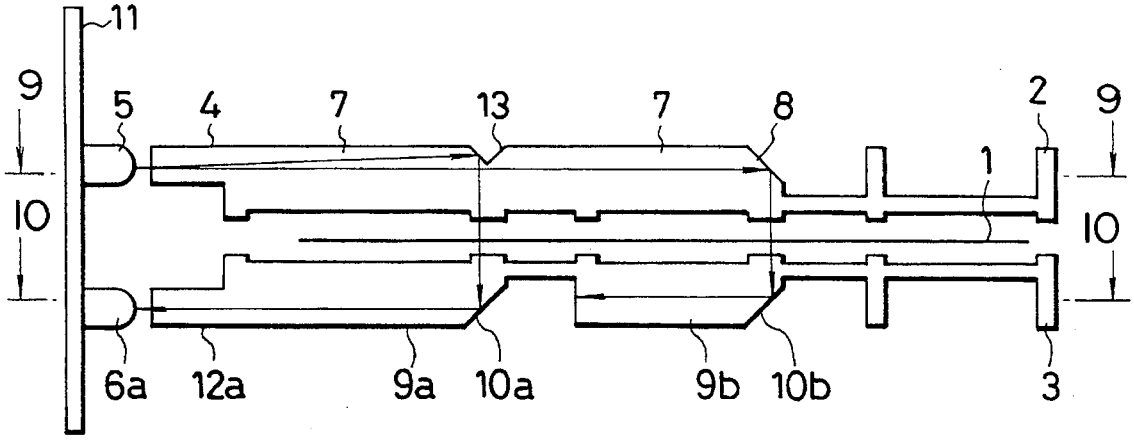
FIG. 7 is a sectional view along line 7—7' in FIG. 6.
Figure 8:
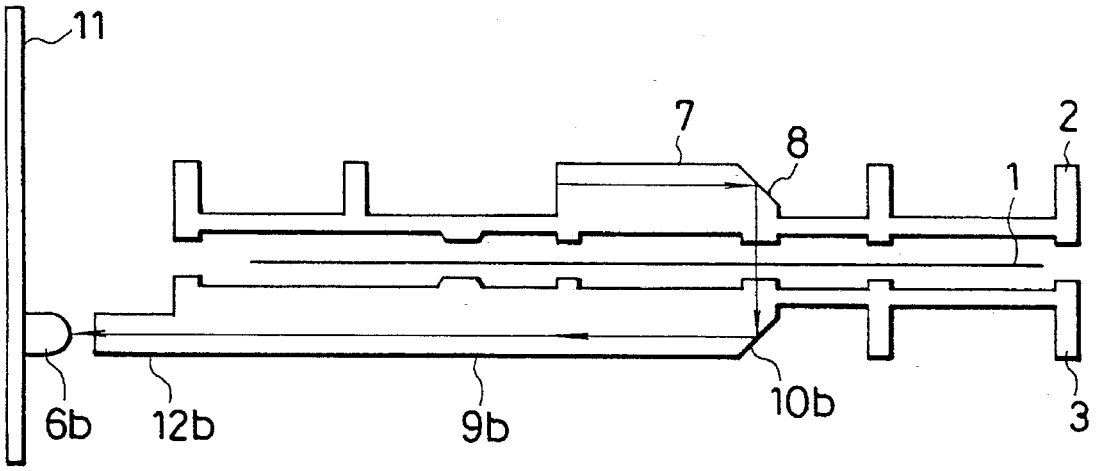
FIG. 8 is a sectional view along line 8—8" in FIG. 6.

Referring to FIG. 7, which is a sectional view through line 7—7' in FIG. 6, light emitted by light-emitting element 5 is partially reflected at reflector 13. The light reflected by reflector 13 crosses the media transport path to reflector 10a in the lower media guide 3. The remaining light travels on to reflector 8, where it is reflected across the transport path to reflector 10b. The light reflected to reflector 10a returns as shown to light-sensing element 6a. Referring to FIG. 8, which is a sectional view along bent line 8—8" in FIG. 6, the light reflected to reflector 10b travels through light guide 9b and exits at exit port 12b to light-sensing element 6b.

Figure 9:
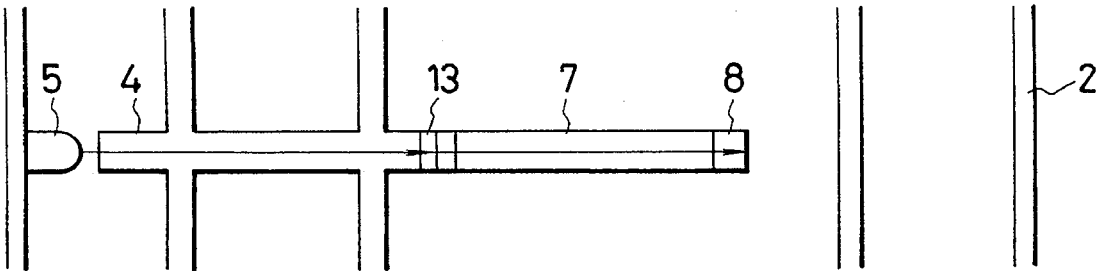
FIG. 9 is a sectional view along line 9—9' in FIG. 7.
Figure 10:
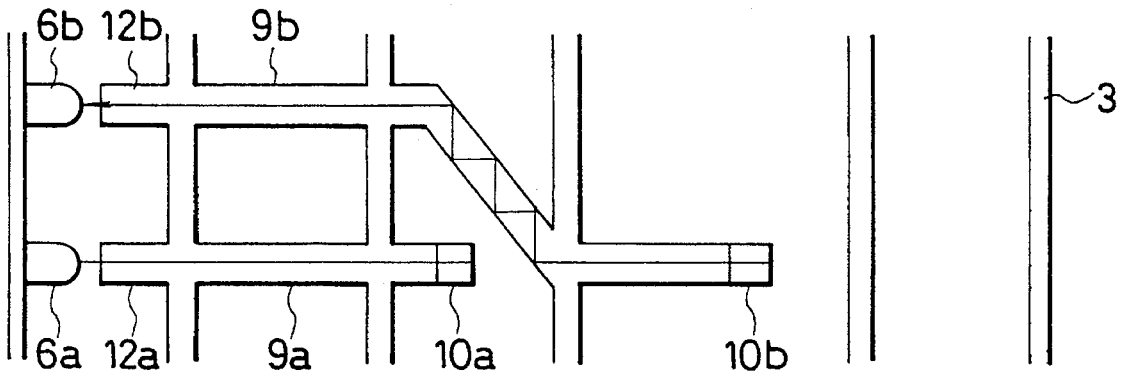
FIG. 10 is a sectional view along line 10—10' in FIG. 7.

FIG. 9 is a sectional plan view of part of the upper media guide 2 through line 9—9' in FIG. 7, showing the single light-emitting element 5, entry port 4, light guide 7, and reflectors 8 and 13. FIG. 10 is a sectional plan view of part of the lower media guide 3 through line 10–10' in FIG. 7, showing the same structure as in FIG. 5.

The second embodiment operates in the same way as the first, but is even simpler in structure, more reliable, and less expensive, because it has only a single light-emitting element 5.

Figure 11:
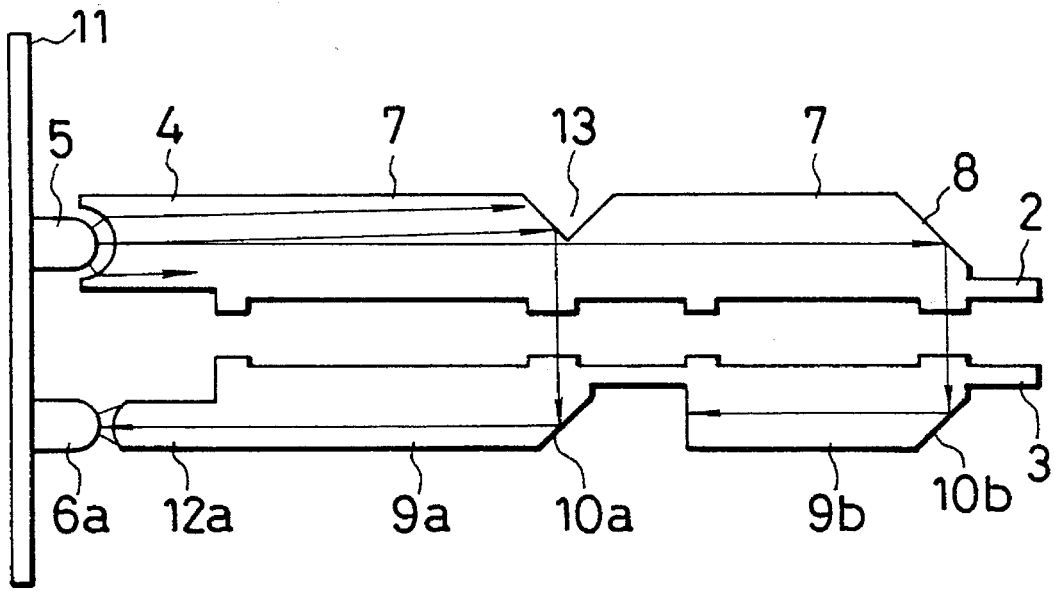
FIG. 11 is a sectional view illustrating a variation of the invented media detector.

FIG. 11 illustrates a variation of the second embodiment in which entry port 4 has a spherically concave surface instead of a flat surface, and exit ports 12a and 12b have spherically convex surfaces. The concave surface of entry port 4 enables more of the light emitted by light-emitting element 5 to be captured and directed through light guide 7 to reflectors 8 and 13. The convex surfaces of exit ports 12a and 12b act as lenses to concentrate the exiting light onto light-sensing elements 6a and 6b. (Light-sensing element 6b and exit port 12b are omitted from FIG. 11.)

These concave and convex surfaces result in a more efficient detector, requiring less electrical power. However, flat surfaces as in FIGS. 1 to 10 have the advantage of easier manufacturability.

Concave and convex surfaces can also be employed for the entry ports 4a and 4b and exit ports 12a and 12b in the first embodiment in FIGS. 1 to 5, with the same advantages.

To mention some other possible variations, the light-emitting and light-receiving elements need not be mounted directly on the printed circuit board 11. They may be mounted on, for example, the sides of the upper and lower media guides 2 and 3, or on members supporting media guides 2 and 3, and coupled to the printed circuit board 11 by short cables which will not interfere with maintenance. Light guides 7, 7a, 7b, 9a, and 9b and their associated ports and reflectors need not be unitary with the upper and lower media guides 2 and 3. For example, the light guides can be formed from a transparent material, then mounted as components in the upper and lower media guides 2 and 3, other components of which have been formed separately from an opaque material. Reflective coatings may be omitted if adequate internal reflection is obtained without them.

The roles of the upper and lower media guides 2 and 3 may be reversed, with the light-emitting elements facing the lower media guide 3 and the light-sensing elements facing the upper media guide 2. The transport path need not be horizontal; it may be vertical or have any other orientation. The surfaces of the media guides 2 and 3 need not be flat.

Those skilled in the art will recognize that still further modifications can be made without departing from the scope of the invention as claimed below.

What is claimed is:

1. A media detector for detecting the presence of a flat media, comprising:

a first media guide and a second media guide each having facing surfaces disposed opposite to each other forming a media transport path therebetween for the transport of the flat media therein;

a light entry port disposed in said first media guide;

a first reflector disposed in said first media guide for reflecting light across said transport path;

a first light guide disposed in and integral with said first media guide for guiding the light from said light entry port to said first reflector;

a second reflector disposed in said second media guide for receiving and reflecting the light reflected across said transport path from said first reflector;

an exit port disposed in said second media guide on an edge of said second media guide for the exit of the lights, a second light guide disposed in and integral with said second media guide for guiding the light from said second reflector to said exit port;

a light-emitting element for emitting the light to said entry port disposed so as to face said entry port, said light emitting element being spaced and separate from said entry port; and a light-sensing element for receiving the light from said exit port and converting the light into an electrical signal disposed so as to face said exit port and so as to be spaced and separate from said exit port;

wherein said entry port has a concave surface for capturing light emitted from said light-emitting element; and wherein said exit port has a convex surface for concentrating the light onto said light-sensing element.

2. The detector of claim 1, wherein said entry port has width and height dimensions at least equal to corresponding dimensions of said light-emitting element.

3. The detector of claim 1, wherein said exit port has width and height dimensions at least equal to corresponding dimensions of said light-sensing element.

4. A media detector for detecting the presence of a flat media, comprising:

a first media guide and a second media guide each having facing surfaces disposed opposite to each other forming a media transport path therebetween for the transport of the flat media therein;

a light entry port disposed in said first media guide;

a first reflector disposed in said first media guide for reflecting light across said transport path;

a first light guide disposed in and integral with said first media guide for guiding the light from said light entry port to said first reflector;

a second reflector disposed in said second media guide for receiving and reflecting the light reflected across said transport path from said first reflector;

an exit port disposed in said second media guide on an edge of said second media guide for the exit of the light;

a second light guide disposed in and integral with said second media guide for guiding the light from said second reflector to said exit port;

a light-emitting element for emitting the light to said entry port disposed so as to face said entry port, said light emitting element being spaced and separate from said entry port; and a light-sensing element for receiving the light from said exit port and converting the light into an electrical signal disposed so as to face said exit port and so as to be spaced and separate from said exit port;

wherein said first media guide and said second media guide each comprise a flat plate having a back supported by a plurality of ribs, wherein said entry port and said first reflector are integrated with said ribs of said first media guide and said exit port and said second reflector are integrated with said ribs of said second media guide, and wherein respective ribs of said first media guide and said second media guide are used as and define said first light guide and said second light guide; and wherein said first and second media guides are separate from each other and separated by said transport path.

5. The detector of claim 4, and further comprising a printed circuit board on which said light-emitting element and said light-sensing element are mounted and electronic circuitry on said printed circuit board to which said light-emitting and said light-sensing elements are coupled by printed wiring traces.

6. The detector of claim 4, and further comprising:

a second light-emitting element and a second light-sensing element;

wherein said first media guide further comprises a third light guide having a second light entry port and a third reflector such that said first and second light entry ports face said first and second light-emitting elements for receiving light therefrom; and wherein said second media guide further comprises a fourth light guide having a second exit port and a fourth reflector such that said second and fourth reflectors face said first and third reflectors in said first media guide and said first and second exit ports face said first and second light-sensing elements for the exit of light thereto.

7. The detector of claim 6, wherein said first and third reflectors in said first media guide are disposed in a straight line perpendicular to a direction of travel of media along said transport path.

8. A media detector for detecting the presence of a flat media, comprising:

a first media guide and a second media guide each having facing surfaces disposed opposite to each other forming a media transport path therebetween for the transport of the flat media therein;

a light entry port disposed in said first media guide;

a first reflector disposed in said first media guide for reflecting light across said transport path;

a first light guide disposed in and integral with said first media guide for guiding the light from said light entry port to said first reflector;

a second reflector disposed in said second media guide for receiving and reflecting the light reflected across said transport path from said first reflector;

an exit port disposed in said second media guide on an edge of said second media guide for the exit of the light;

a second light guide disposed in and integral with said second media guide for guiding the light from said second reflector to said exit port;

a light-emitting element for emitting the light to said entry port disposed so as to face said entry port, said light emitting element being spaced and separate from said entry port;

a first light-sensing element for receiving the light from said exit port and converting the light into an electrical signal disposed so as to face said exit port and so as to be spaced and separate from said exit port; and a second light-sensing element;

wherein said first light guide further comprises reflector for reflecting light across said transport path; and wherein said second media guide further comprises a third light guide having a second exit port and a fourth reflector, said second and fourth reflectors being disposed to receive light from said first and third reflectors, respectively, and said exit ports being disposed to face respective ones of said light-sensing elements for transmitting light thereto.

9. The detector of claim 8, wherein at least one of said first and third reflectors comprises a V-shaped notch formed at an intermediate position in said first light guide for reflecting part of the light guided by said first light guide.

10. The detector of claim 9, wherein said first light guide extends in a straight line perpendicular to a direction of travel of media along said transport path.

11. The detector of claim 10, wherein said second and fourth reflectors are disposed at regular intervals in a straight line parallel to said first light guide.

12. A method of detecting media, comprising the steps of:

transporting media along a transport path formed by and between a first media guide and second media guide;

emitting light from a light-emitting element into the first media guide;

reflecting the light within the first media guide across the transport path;

receiving the light reflected across the transport path within the second media guide and reflecting the light within the second media guide so that the light exits from the second media guide; and receiving the light that exits the second media guide with a light sensing element and converting the received light into an electrical signal wherein the light is reflected at a first plurality of points within the first media guide, crosses the transport path at a plurality of positions corresponding in number to said first plurality of points, is reflected within the second media guide at a second plurality of points corresponding in number to said first plurality of points, and exits from the second media guide to a plurality of light-sensing elements corresponding in number to said first plurality of points; and wherein said step of emitting the light comprises emitting the light from a single light-emitting element.

13. The method of claim 12, and further comprising the steps of:

guiding the light with a first light guide in the first media guide; and partially reflecting the light with at least one intermediate reflector in the first light guide.

* * * * *